United States Patent [19]

Shrader

[11] 3,950,720

[45] Apr. 13, 1976

[54] ADJUSTABLE SPRING MOUNT FOR A CATHODE RAY TUBE YOKE

[75] Inventor: Terry Monroe Shrader, Leola, Pa.

[73] Assignee: RCA Corporation, New York, N.Y.

[22] Filed: Jan. 7, 1975

[21] Appl. No.: 539,099

[52] U.S. Cl. ..... 335/210; 178/7.81

[51] Int. Cl.² ..... H01F 7/00

[58] Field of Search ..... 178/7.8, 7.81; 335/210

[56] References Cited

UNITED STATES PATENTS

| | | | |
|---|---|---|---|
| 3,602,853 | 8/1971 | Cummings | 178/7.81 X |
| 3,629,751 | 12/1971 | Massa | 335/210 |
| 3,637,930 | 1/1972 | Meier | 335/210 |
| 3,657,674 | 4/1972 | Goldammer et al. | 178/7.81 X |
| 3,697,909 | 10/1972 | Christensen et al. | 335/210 |

*Primary Examiner*—G. Harris

*Attorney, Agent, or Firm*—Glenn H. Bruestle; Dennis H. Irlbeck

[57] ABSTRACT

The mount comprises a first portion adapted for receiving a yoke, a second portion adapted for connection to a cathode-ray tube, a plurality of adjustable springs interconnecting the first and second portions and means for locking the first and second portions together. The adjustable springs permit movement of the yoke along one axis while securing its position along an orthogonal axis. In one preferred embodiment, a platform is provided with projections extending therefrom. A housing on which a yoke may be mounted, is attached to the projections. The housing includes a plurality of bow springs located between the points of attachment to the projections and the yoke attachment area. Means also are included to secure the bow springs in their adjusted positions.

24 Claims, 24 Drawing Figures

ADJUSTABLE SPRING MOUNT FOR A CATHODE RAY TUBE YOKE

BACKGROUND OF THE INVENTION

This invention relates to means for mounting a magnetic deflection yoke on the neck of a cathode-ray tube and particularly to an adjustable mount utilizing a plurality of adjustable springs.

Cathode-ray tubes, such as color television picture tubes, require a magnetic-deflection yoke mounted on the outside of the tube envelope. The yoke comprises horizontal and vertical deflection coils together with a suitable core. During operation of the tube, the yoke field deflects electron beams within the tube in both the vertical and horizontal directions thereby causing the beams to scan the viewing screen of the tube.

Several structures have been proposed for mounting and holding the yoke in a desired position on the tube. In one structure, the yoke is placed in a housing which is in turn positioned on and glued to the tube. In another structure, the housing is clamped on the tube and the yoke is positioned within the housing and clamped in place. In a third structure, a platform first is glued to the outside of the tube and then the yoke and housing are positioned over the tube and clamped to the platform. An improved structure is presented in U.S. Pat. No. 3,786,185 issued to me on Jan. 15, 1974. This patent discloses a combination including a platform affixed to a cathode-ray tube by an adhesive and a yoke housing enclosing a portion of the yoke. The platform has a plurality of projections that are secured within indentations in the yoke housing.

A disadvantage shared by all of the foregoing yoke mounting structures is that once they have been attached to a tube, further adjustment of yoke position is not possible without losing the entire alignment of the yoke relative to the tube. Furthermore, in those yoke mounting schemes requiring permanent attachment of the yoke to a tube, once the adhesive has set, the mount may be destroyed when the yoke is removed. Therefore, there is a need for a permanently affixed mount that provides means permitting minor adjustments of the yoke after the mount is attached to a tube.

The present invention maintains many of the advantages of prior art structures while providing means that permit minor adjustment along one axis while maintaining rigidity along another axis.

SUMMARY OF THE INVENTION

A yoke mount for a cathode-ray tube comprises a first portion adapted for receiving a yoke, a second portion adapted for securing to the tube, adjustable spring means connecting the first and second portions, the spring means including means for maintaining the position of the first portion along a first axis while permitting movement of the first portion relative to the second portion along a second axis and means for securing the position of the first portion relative to the second portion.

DESCRIPTION OF THE PREFERRED EMBODIMENTS

Figure 1:
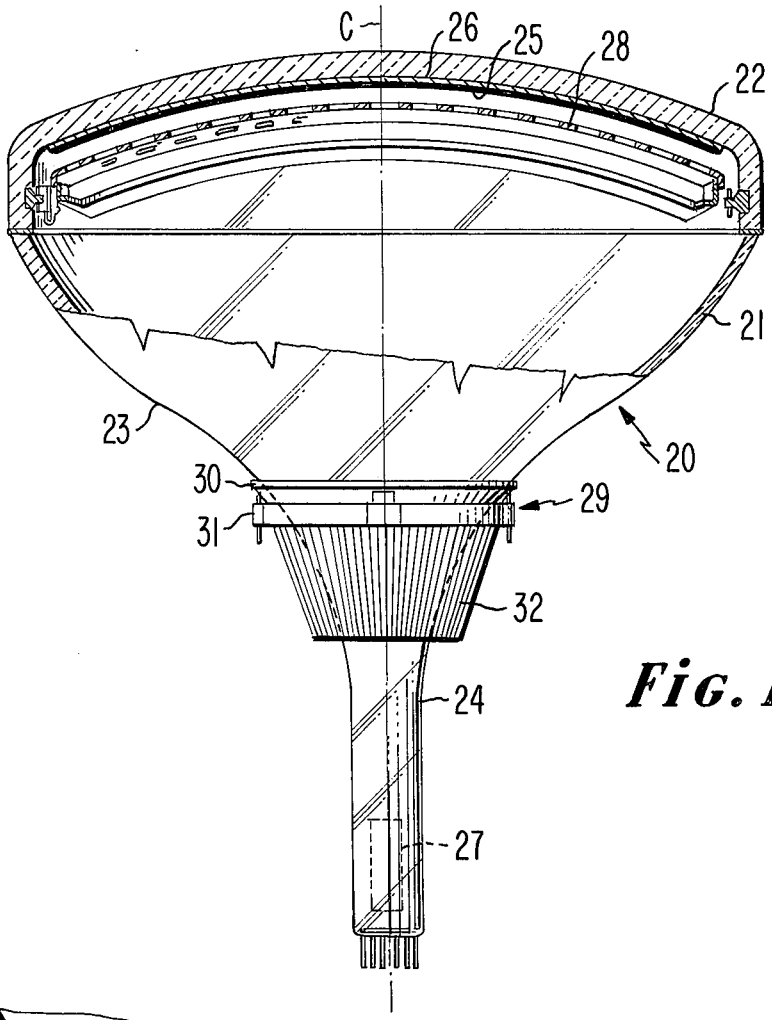
FIG. 1 is a partially cutaway side elevational view of a cathode-ray tube having a first yoke mount thereon.

FIG. 1 illustrates a color television picture tube 20 of the apertured-mask type comprising an evacuated glass envelope 21. The envelope 21 includes a faceplate panel 22, a funnel 23, and a neck 24. A three-color-emitting phosphor viewing screen 25 is supported on the inner surface 26 of the faceplate panel 22. A preferred viewing screen 25 is of a known type comprising parallel lines or strips of the different color-emitting phosphors. An electron-gun assembly 27 positioned in the neck 24 includes three electron guns (not shown) one for each of the three color phosphors on the viewing screen 25. An apertured mask 28 is positioned in the envelope 21 adjacent the viewing screen 25. The apertured mask 28, used with the line-type viewing screen 25, includes slot-shaped apertures. The electron gun assembly 27 is adapted to project three electron beams toward the faceplate panel 22 through the apertured mask 28 to strike the viewing screen 25. The preferred electron-gun assembly 27 is of an inline type, that is, a type which projects a plurality of electron beams from a common plane toward the screen 25.

Attached to the outside of the tube 20, is a yoke mount 29 comprising a platform 30 and a housing 31. The platform 30 is fixed to the outside surface of the funnel 23 and the housing 31 shown with a yoke 32 mounted thereon is positioned on the platform 30 near the intersection of the funnel 23 and neck 24. A preferred yoke 32 is comprised of two pairs of opposed magnetic-field producing coils (not shown) having toroidal windings. The housing 31 with the yoke 32 thereon is mounted on the platform 30, as will be described.

Figure 2:
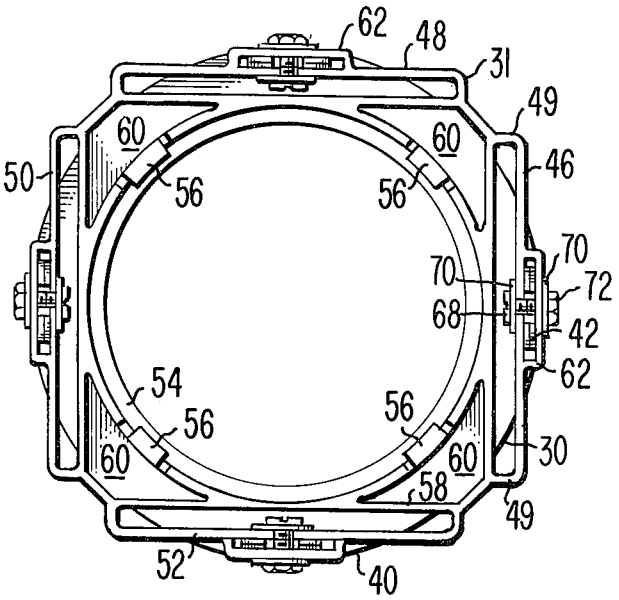
FIGS. 2 and 3 are respective top plan and side elevational views of the yoke mount of FIG. 1.
Figure 3:
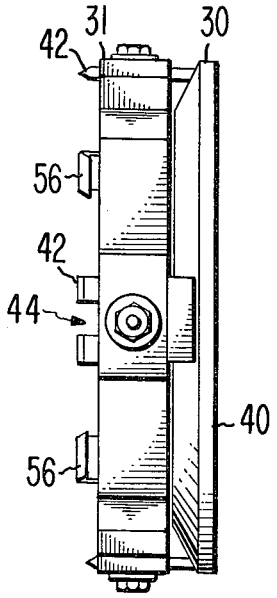
Figure 5:
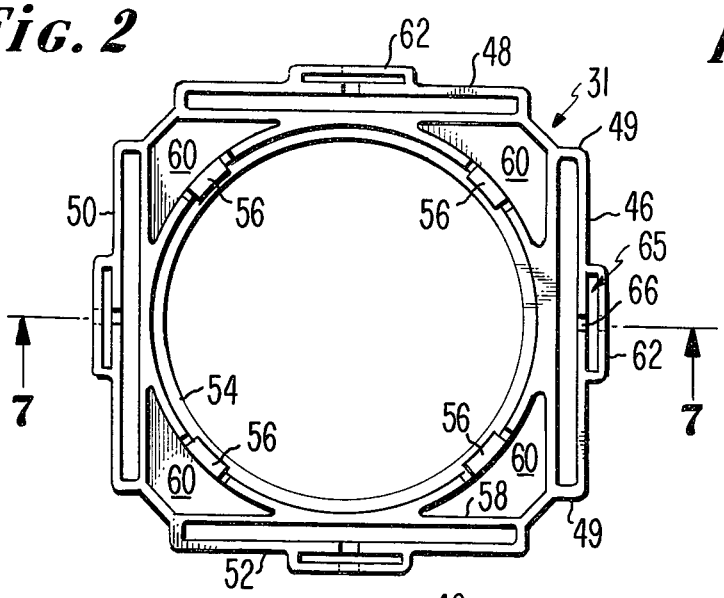
FIG. 5 is a top plan view of the housing portion of the mount shown in FIG. 1.
Figure 4:
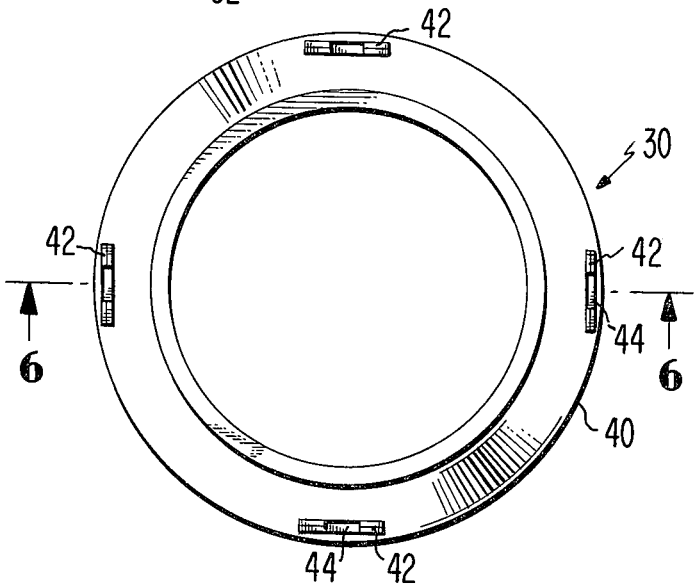
FIG. 4 is a top plan view of the platform portion of the mount shown in FIGS. 2 and 3.
Figure 7:
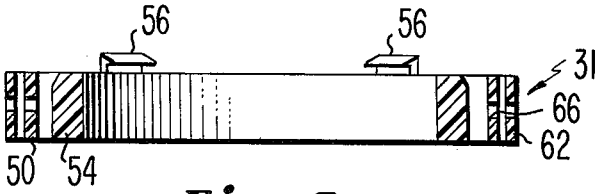
FIGS. 6 and 7 are side elevational views, respectively, platform and housing of FIGS. 4 and 5 in their preassembly orientation.
Figure 6:
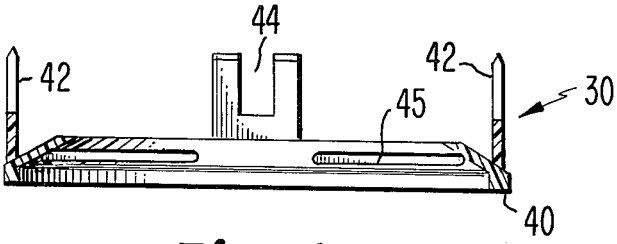

The specific details of the platform 30 and housing 31 are shown in FIGS. 2, 3, 4, 5, 6 and 7. FIGS. 2 and 3 illustrate the mount 29, including the platform 30 and the housing 31 in their operational relationship. FIGS. 4 and 5 show the platform 30 and housing 31, respectively, separated. FIGS. 6 and 7 are respective side view of FIGS. 4 and 5.

The platform 30 (FIGS. 4 and 6) comprises a short conical member 40 having an interior surface that substantially conforms to the shape of the exterior surface of the funnel to which it will be attached. Four studs or projections 42 extend from the ring 40 parallel to the central axis of the ring. These projections 42 have central slits 44 therein for permitting attachment to the housing 31 as will be described later.

In order to facilitate attachment to a tube, the inner surface of the annular ring 40 may have a plurality of recesses 45 therein for receiving a suitable adhesive material. Preferably, a hot-melt thermoplastic adhesive, such as the following, may be used:

| Material Designation | Marketed By | Melting Temperature |
|---|---|---|
| Versalon 1300 | General Mills Chemical Co., Minneapolis, Minn. | 92°C. |
| Versalon 1138 | " | 125°C. |
| Versalon 1165 | " | 134°C. |
| Resyln 34-2927 | National Starch and Chemical Corp., New York, N. Y. | 58°C. |

The housing 31 (FIGS. 5 and 7) includes four bow springs 46, 48, 50 and 52 disposed in a square pattern about a central retaining ring 54. A bow spring is defined as an elongated straight spring supported at its two ends. In the present embodiment, the springs 46, 48, 50 and 52 are supported by two intermediate portions 49 that are substantially perpendicular to the elongated springs. Because of the intermediate portions 49, the springs are capable of bending or bowing transversely. Two bow springs 46 and 50 comprise one pair of springs and the other bow springs 48 and 52 comprise a second pair. The function of each of the bow spring pairs will be described later.

The retaining ring 54 is large enough to fit over the end of a tube funnel without touching it when the housing 31 is mounted on the platform 30. Four lugs 56 are provided on the retaining ring 54 to permit snap-on attachment of a yoke. The ends of each bow spring are connected to a substantially square flange 58 that extends around the retaining ring 54 and is joined to the ring 54 tangentially at four equally spaced points. Web portions 60 also connect the flange 58 to the retainer ring 54 in the corners of the housing 31.

Externally formed on each bow spring is a small bracket 62. A slot 65 is located between each bracket 62 and its associated bow spring. Each slot 65 is dimensioned to receive a projection 42 of the platform 30, leaving sufficient space on either side of the projection to permit adjustment of the projection when aligning the yoke. As shown in FIG. 2, the central slits 44 in the projections 42 are aligned with holes 66 in the brackets 62 and bow springs to permit the insertion of bolts 68 therethrough and the attachment of washers 70 and nuts 72 thereto. Upon tightening the bolts 68 and nuts 72, the bracket 62 and bow spring (46) press against the platform projections 42 thus securing the position of the housing 31 relative to the platform 30. Later or alternately, the projections 42 may be either glued into the slots 64 or ultrasonically welded within the slots 65 to permanently fix the position of the bow springs. If later welded or glued, the bolts may thereafter be removed.

Figure 8:
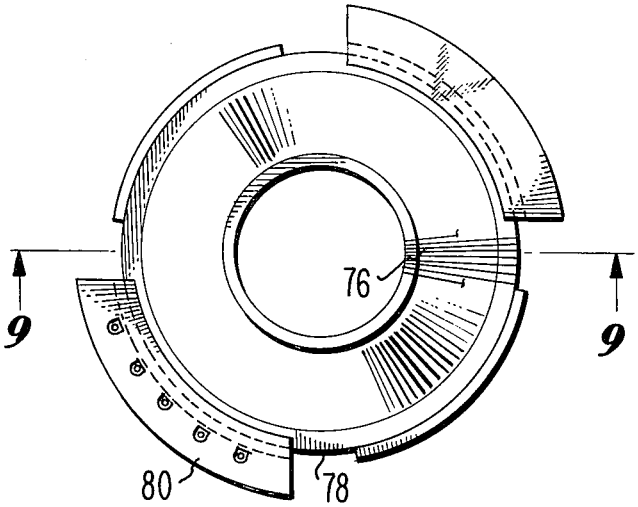
FIG. 8 is a top plan view of a yoke mounting ring having a terminal board and yoke thereon.
Figure 9:
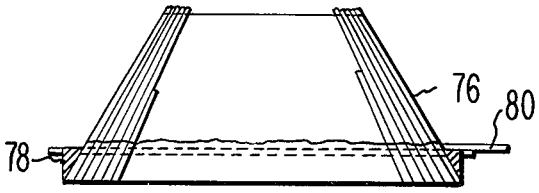
FIG. 9 is a side elevational view of the mounting ring of FIG. 8.

FIGS. 8 and 9 show an illustrative yoke 76 mounted on a yoke mounting ring 78 having a terminal board 80 affixed thereto for electrical connection with the yoke 76. The combination of FIGS. 6, 7 and 9 presents an exploded view of the platform 30, housing 31 and mounting ring 78, respectively, in their relative positions prior to assembly.

Figure 10:
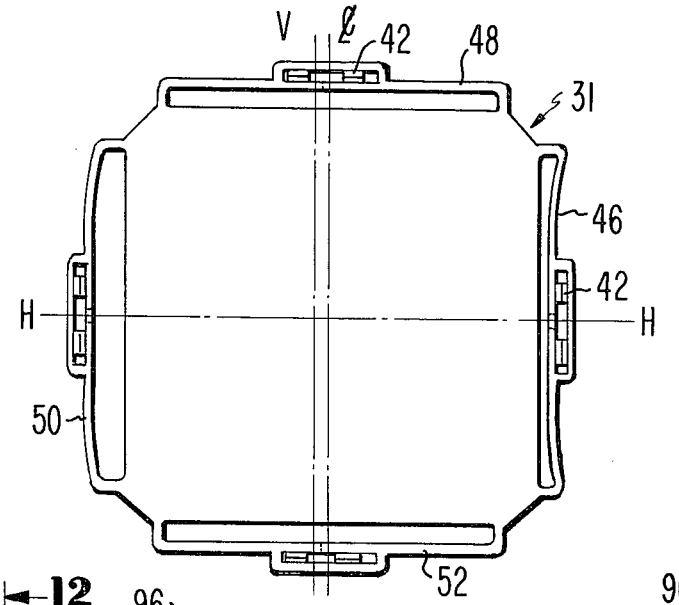
FIG. 10 is an illustrative plan view of a housing illustrating functioning of bow springs.
Figure 11:
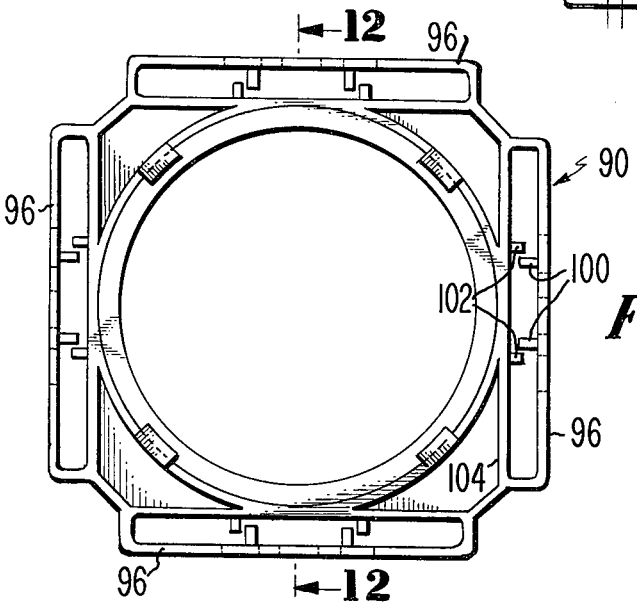
FIGS. 11 and 12 are respective top plan and side elevational views of a housing for a second mount embodiment.
Figure 12:
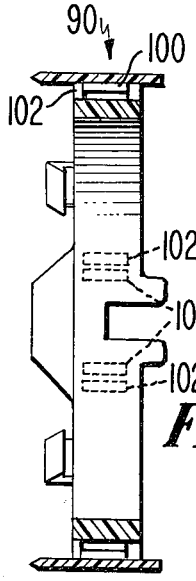
Figure 13:
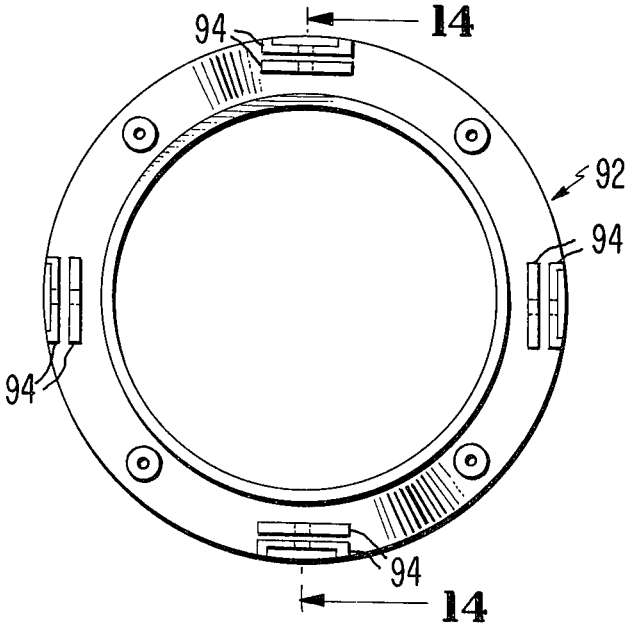
FIGS. 13 and 14 are respective top plan and side elevational views of a platform for the second mount embodiment.
Figure 14:
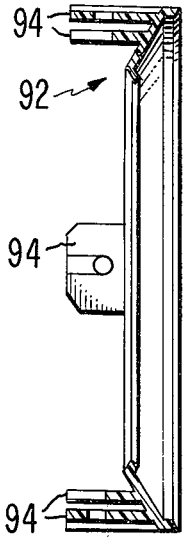

The function of the bow springs is illustrated in FIG. 10. In this illustration, the top and bottom bolts 68 along the vertical axis, V—V, are loosened and the center of the housing 31 on which the yoke 76 may be mounted, is moved to the right. This movement causes the end of the left bow spring 50 to be pulled to the right and the ends of the right bow spring 46 to be forced to the right. Since the projections 42 are rigid, this movement causes the spring 46 and 50 to bow. It should be noted that for this movement, which will provide a horizontal correction in yoke location, the two bolts 68 on the horizontal axis, H—H, are not loosened. Therefore, movement of the yoke horizontally cannot affect vertical position of the yoke. Similarly, if the two horizontal axis bolts are loosened and the vertical axis bolts remain tightened, the yoke may be displaced vertically without affecting horizontal position. Once the yoke is in a desired position, any bolts that have been loosened are retightened.

The housing 31 may also be adjusted about the vertical and horizontal axis when all bolts are loosened, if sufficient tolerance is provided between the brackets 62 and the projections 42. Furthermore, when all bolts are loosened, the yoke may be moved forward and back along a central axis, C—C, passing through the tube.

A second embodiment of the present invention is shown in FIGS. 11, 12, 13 and 14. The basic structure of a housing 90 and platform 92 in this embodiment is similar to that of the first embodiment except that brackets are formed by double projections 94 on the platform. The bowsprings 96 in this embodiment fit between the double projections 94. The spaces between the projections 94 are sufficiently wide to permit adjustment of the housing 90 relative to the platform once bolts have been inserted through holes in the projections 94 and bowsprings 96.

The second embodiment also shows another feature that may be optionally added to the bow springs. This feature is internal protrusions 100 on the bow spring and internal protrusions 102, on an opposite inner flange 104. When the yoke has been positioned into its final location, an adhesive may be applied between the protrusions 100 and 102 so that the position of the yoke, if desired, may be permanently fixed relative to the tube.

Figure 15:
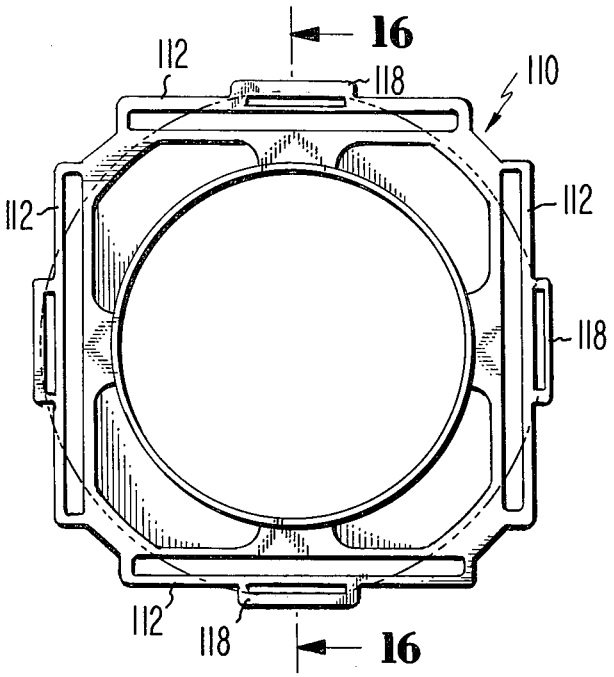
FIGS. 15 and 16 are respective top plan and side elevational views of a platform for a third mount embodiment.
Figure 16:
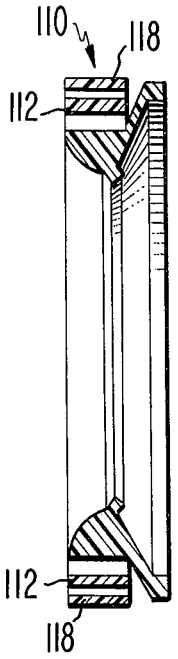
Figure 17:
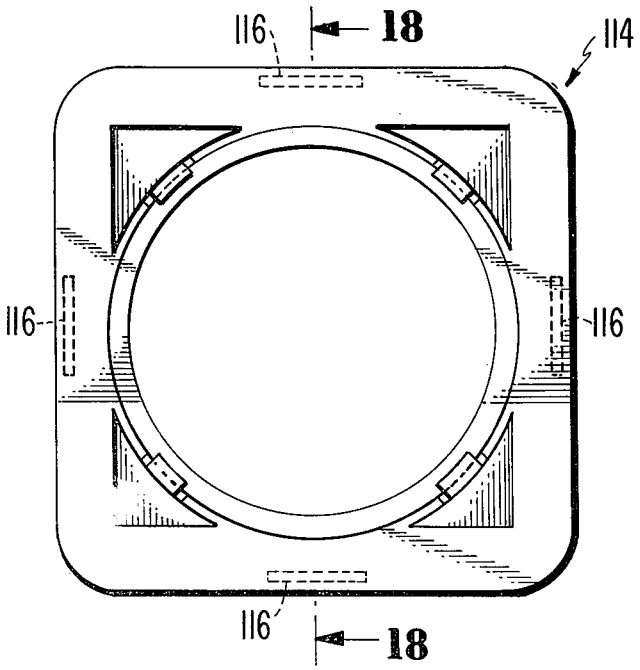
FIGS. 17 and 18 are respective top plan and side elevational views of a housing for the third mount embodiment.
Figure 18:
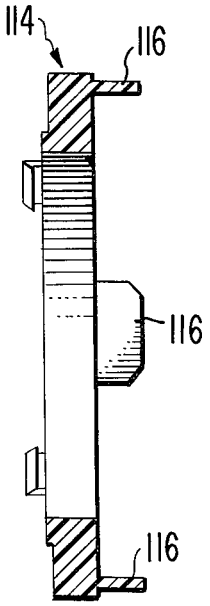

Although heretofore, the bow springs have been described as being part of the yoke housing, the bow springs alternatively may be made part of the platform. FIG. 15 and 16 show a platform 110 of a third mount embodiment having four bow springs 112 constructed integrally therewith. A yoke housing 114 for the third embodiment is shown in FIGS. 17 and 18. In this particular embodiment, projections 116 are located on the housing 114 and brackets 118 are located on the bow springs 112. Of course this embodiment could also be modified to include a reversal of the projections and brackets and to include protrusions within the bow springs to permit permanent affixation of the springs.

Figure 19:
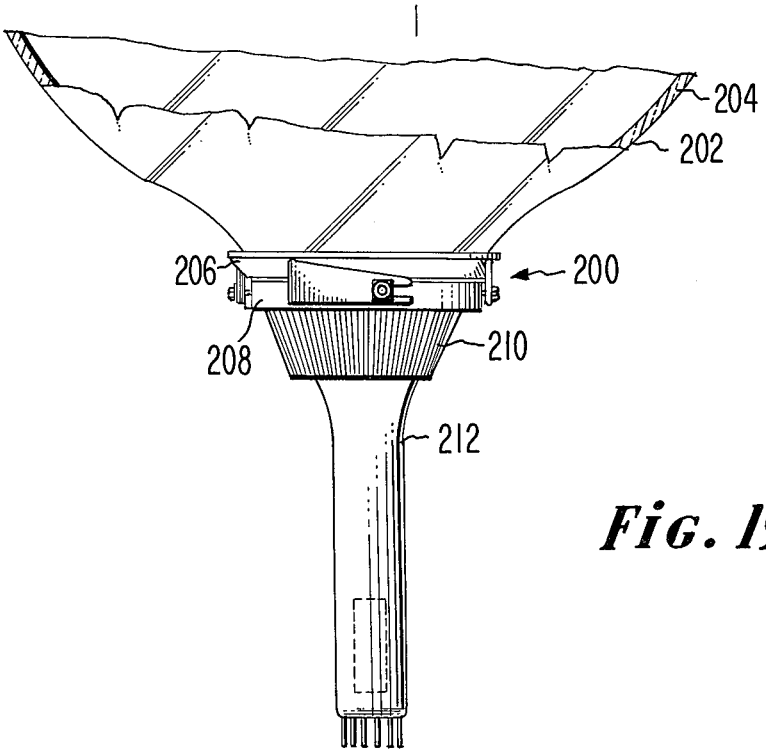
FIG. 19 is a partial side elevational view of a cathode-ray tube incorporating another yoke mount embodiment according to the present invention.

Another embodiment of a yoke mount 200 is shown in FIG. 19 wherein the yoke mount 200 is attached to the funnel 202 of a cathode-ray tube 204 (shown in partial view). The yoke mount 200 comprises a platform 206 and a housing 208. The platform 206 is permanently fixed to the outside surface of the funnel 202, and the housing 208, shown with a yoke 210 mounted thereon, is positioned on the platform 206 near the intersection of the funnel 202 and the tube neck 212. A preferred yoke 210 is comprised of two pairs of opposed magnetic-field producing coils (not shown) having toroidal windings.

Figure 20:
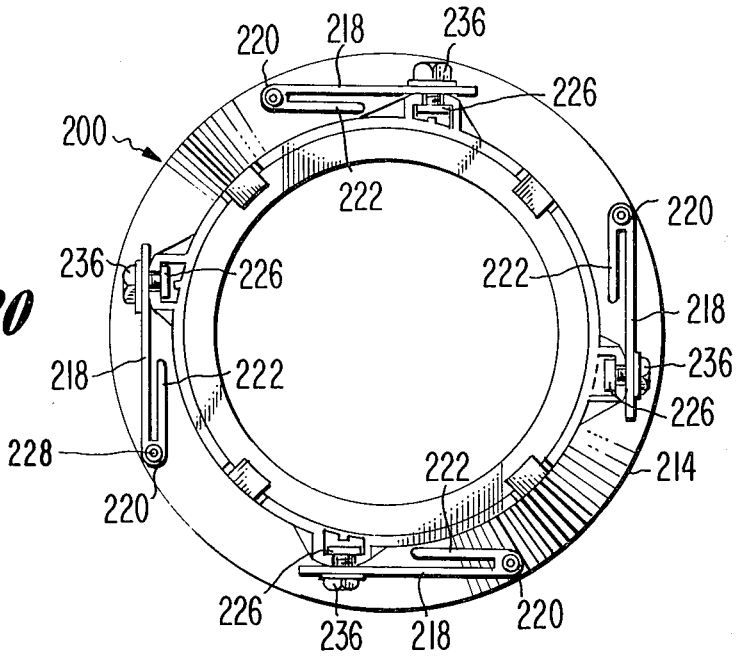
FIG. 20 is a plan view of the yoke mount of FIG. 19 taken along line 20—20 of FIG. 19.
Figure 21:
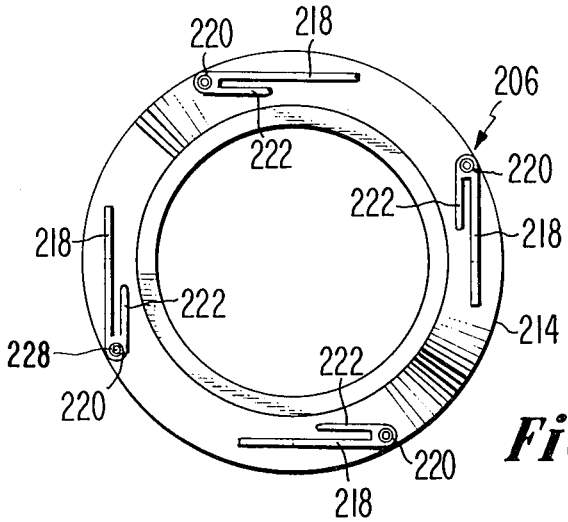
FIGS. 21 and 22 are respective plan and elevational views of the platform portion of the mount of FIG. 19.
Figure 22:
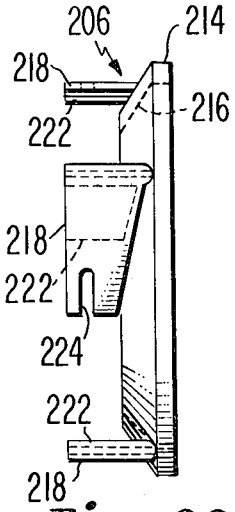
Figure 23:
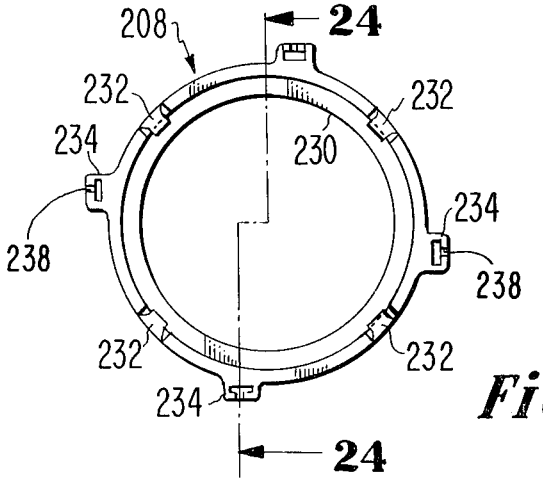
FIGS. 23 and 24 are respective plan and sectional views of the yoke housing portion of the mount of FIG. 19, FIG. 24 being taken along line 24—24 of FIG. 23.
Figure 24:
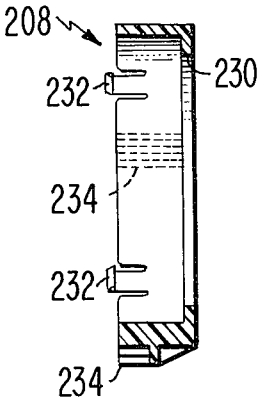

The specific details of the yoke mount 200 are better illustrated in FIGS. 20 through 24. FIG. 20 shows a plan view of the complete mount 200; FIGS. 21 and 22 show two views of the platform 206; and FIGS. 23 and 24 show two views of the housing 208.

The platform 206 comprises an annular ring 214 having an inside surface 216 that substantially conforms to the exterior surface of the funnel 202. Four spaced cantilever leaf springs 218 extend tangentially clockwise around the outer surface of the ring 214 from posts 220 which are parallel to the central axis of the platform 206. The posts 220 provide the sole support for the springs 218. A flange 222 spaced from but parallel to the springs 218, is molded directly to each post 220 and to the annular ring 214 to provide rigidity for the posts 220 and springs 218. Each springs 218 has an open slot 224 extending in the longitudinal direction of the spring to receive a bolt 226 used in attaching the housing 208 to the springs 218. Although the cantilevered leaf springs 218 are shown extending clockwise, they alternatively may be disposed counterclockwise.

In this embodiment, the posts 220 have central conduits 228 extending through to the inside surface 216 of the ring 214 to permit the insertion of an adhesive material to permanently affix the platform 206 to the tube 204.

In order to facilitate attachment to a tube, the inner surface of the annular ring 214 may have a plurality of recesses (not shown) therein for receiving a suitable adhesive material.

The housing 208 is cylindrically shaped and includes an annular inner ledge 230 therein to facilitate attachment of the yoke 210. The yoke 210 is held in the housing 208 by four integrally formed clips 232 spaced around the periphery of the housing 208. Four brackets 234 are spaced peripherally around the exterior surface of the housing 208 to mate with the four leaf springs 218 on the platform 206. Each bracket 234 extends down the side of the housing 208 and is formed to support the head of the bolt 226 in correct position to mate with the slots 224 in the springs 218.

The mount 200 is assembled by first attaching the platform 206 to the tube 204. The position of this platform is not critical but it must be positioned within reasonable tolerances to permit full motion of the housing 208 during adjustment of the yoke 210.

Separate from the tube 204, the yoke 210 is mounted in the housing 208 by inserting the yoke 210 and snaping the clips 232 over detents formed on the yoke 210. The bolts 226 are next slipped into the brackets 234 and washers and nuts 236 attached thereto. At this point, the nuts 236 are not tightened but remain loose at the end of the bolts 226.

Next the housing 208 is inserted into the platform 206 in an orientation approximately 45° clockwise from its intended final orientation. Thereafter, the housing 208 is rotated counterclockwise to position the bolts 226 within the slots 224 of the springs 218. Now, the tube 204 is activated and the yoke 210 and housing 208 are moved until the yoke 210 is aligned with the electron beams within the tube 204. Once correct alignment is achieved, the nuts 236 are tightened. Thereafter if desired, the springs may be either ultrasonically welded or glued to the brackets 234.

It should be noted that the springs 218 provide great latitude for moving the yoke 210 transverse to the central axis C—C of the tube 204. Rotation of the yoke 210 is permitted by the slots 224 in the springs 218 and movement along the tube axis is permitted by slots 238 in the brackets 234. Transverse adjustment of the yoke 210 will cause a bending of the springs 218. This bent position of the springs is maintained once all four nuts 236 are tightened.

Once the yoke 210 position has been fixed, its position can later be adjusted in the vertical direction without affecting its position in the horizontal direction, or its position can be adjusted in the horizontal direction without affecting its position in the vertical direction. For example, if it is desired to move the yoke slightly vertically without affecting its horizontal position, the two horizontal nuts 236 can be loosened and the yoke 210 moved vertically while the two vertical nuts 236 remain tightened. Similarly, horizontal movement can be made by loosening the vertical nuts 236. Such confined single-axis adjustment greatly simplifies procedures for aligning the yoke with the electron beams.

Although the foregoing described embodiment shows placement of the cantilevered leaf springs on the platform, the leaf springs alternately may be located on the housing instead. In such case, the leaf springs would be attachable to posts or brackets located on the platform.

The material for the foregoing embodiment may be any nonconductive material that can be formed with sufficient strength. Various plastics may be used for both the platform and housing. However, because of the heat encountered in an operational tube, a material should be selected that will not deform substantially with increased temperature. Materials that have been found suitable for this purpose are manufactured by the G. E. Corporation under the brand names Lexan 2014 and Noryl SEO-225.

What is claimed is:

1. A yoke mount for a cathode-ray tube comprising,
a first portion adapted for receiving a yoke,
a second portion adapted for securing to a tube,
adjustable spring means connecting said first and second portions and providing the sole support of said first portion relative to said second portion, said spring means including means for maintaining the position of said first portion along a first axis while bending to permit movement of said first portion relative to said second portion along a second axis, and
means for securing the position of said first portion relative to said second portion with said spring means in a bent position.

2. A yoke mount for a cathode-ray tube comprising,
a first portion adapted for receiving a yoke,
a second portion adapted for securing to a tube, adjustable spring means connecting said first and second portions and providing the sole support of said first portion relative to said second portion, said spring means including means for maintaining the position of said first portion along a first axis orthogonal to a central longitudinal axis through a tube while bending to permit relocation of said first portion relative to said second portion along a second axis orthogonal to said first axis and to the central longitudinal axis of a tube, and means for securing the position of said first portion relative to said second portion with said spring means in a bent position.

3. The yoke mount as defined in claim 2, wherein said adjustable spring means includes a plurality of bow springs, the ends of which are attached to one of said portions and the centers of which are adjustably connected to the other portion.

4. The yoke mount as defined in claim 2, wherein said adjustable spring means includes a plurality of cantilevered springs, each having one end attached to one of said portions and the other end adjustably connected to the other portion.

5. A yoke mount for a cathode-ray tube comprising, a first portion adapted for receiving a yoke, a second portion adapted for connection to a tube, a plurality of bow springs interconnecting said first portion and said second portion and providing the sole support of said first portion relative to said second portion, the ends of which are attached to one of said portions and the centers of which are adjustably connected to the other portion, and means for locking said bow springs in bowed positions.

6. A yoke mount for a cathode-ray tube comprising, a central portion having an opening therein for receiving a yoke, an outer portion connectable to a tube, four bow springs positioned between said central portion and said outer portion, said bow springs being disposed in parallel pairs on opposite sides of said mount, the ends of said bow springs being attached to one of said portions and the centers of said bow springs being adjustably connected to the other portion, and means for locking said bow springs in bowed positions.

7. The yoke mount as defined in claim 6, wherein adjacent bow springs are mutually orthogonal to each other and all bow springs being bendable within a common plane.

8. The yoke mount as defined in claim 6, wherein said mount is constructed of a magnetically non-conductive material.

9. A yoke mount for a cathode-ray tube comprising, a platform having an inner surface conforming to a portion of said tube and having a plurality of projections extending therefrom, a housing including means for mounting a yoke thereon, said housing having a plurality of bow springs attached at opposite ends to said housing, said bow springs providing the sole connection between said platform and housing, means for fastening the center of said bow springs to said projections and maintaining said bow springs in bowed positions.

10. A yoke mount for a cathode-ray tube comprising, an annular platform having an inner surface substantially conforming to a portion of said tube and having a plurality of projections extending therefrom, a housing having a central opening therein for receiving a yoke, said housing having a plurality of slots adapted to receive to said projections, each of said projections being disposed within said slots, said housing further having four bow springs positioned between said central circular opening and said slots, said bow springs being disposed on opposite sides of said housing in parallel pairs and adjacent springs being orthogonal, and means for securring said projections to said springs.

11. The yoke mount as defined in claim 10, wherein said means for attaching include means for clamping said projections to said housing within said slots.

12. The yoke mount as defined in claim 10, wherein said means for clamping is adjustable.

13. The yoke mount as defined in claim 10, including internal projections within said bow springs for permanently bonding the orientation of said springs.

14. The yoke mount as defined in claim 10, wherein said means for attaching includes ultrasonic welded unions between said projections and said slots.

15. The yoke mount as defined in claim 10, wherein said means for attaching includes an adhesive located between said projections and said slots.

16. A yoke mount for a cathode-ray tube comprising, an annular platform having an inner surface substantially conforming to a portion of said tube and having a plurality of parallel pairs of projections therefrom, a yoke housing having a central opening therein for receiving a yoke, said housing housing four bow springs disposed on opposite sides of said housing in parallel pairs and adjacent springs being orthogonal, each bow spring including a portion located to fit between a pair of parallel projections of said platform, and means for attaching said projections to said bow spring portions.

17. A yoke mount for a cathode-ray tube comprising, a first portion adapted for receiving a yoke, a second portion adapted for connection to said tube, a plurality of cantilevered springs extending from one of said portions tangentially around a tube and adjustably connected at ends thereof to the other portion, said springs being bendable to position said first portion relative to said second portion, and means for locking said springs in bent positions.

18. A yoke mount for a cathode-ray tube comprising, a platform having an inner surface conforming to a portion of a tube and having a plurality of cantilevered springs extending tangentially therefrom, said springs being bendable in a common plane, a housing including means for mounting a yoke thereon, said housing being adjustably connected to and solely supported by said springs, and means for locking said springs in bent positions.

19. The yoke mount as defined in claim 18, wherein said means for locking comprises bolts inserted through slots in the springs and the housing.

20. The yoke mount as defined in claim 18, wherein said means for locking includes ultrasonic welds between said springs and said housing.

21. The yoke mount as defined in claim 18, wherein said means for locking includes an adhesive between said springs and said housing.

22. The yoke mount as defined in claim 18, wherein said platform and housing are constructed of a magnetically nonconductive material.

23. A yoke mount for a cathode-ray tube comprising, an annular platform having an inner surface conforming to a portion of said tube and having four spaced cantilevered springs extending tangentially in the same circumferential direction from posts projecting from an outer surface of said platform, said spring being in parallel pairs, one pair being perpendicular to the other pair, and a housing including means for holding a yoke thereon, said housing being attached to and solely supported by said springs, and means for securing said springs in a set position.

24. A yoke mount for a cathode-ray tube comprising, an annular platform having an inner surface substantially conforming to a portion of a tube and said platform including four bow springs positioned around a central opening in said platform said bow springs being disposed in parallel pairs on opposite sides of said mount, a yoke housing having a central opening therein for receiving a yoke, said housing having projections extending therefrom, and, means for interconnecting said projections to said bow springs.

* * * * *